US008616997B2

(12) United States Patent
Roach et al.

(10) Patent No.: US 8,616,997 B2
(45) **Date of Patent: *Dec. 31, 2013**

(54) MULTI-METAL GOLF CLUBS

(75) Inventors: Ryan L. Roach, Carlsbad, CA (US); Thomas C. Morris, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 195 days.

This patent is subject to a terminal disclaimer.

(21) Appl. No.: 12/902,053

(22) Filed: Oct. 11, 2010

(65) Prior Publication Data

US 2011/0118057 A1 May 19, 2011

Related U.S. Application Data

(63) Continuation of application No. 11/960,809, filed on Dec. 20, 2007, now Pat. No. 7,811,179, which is a continuation-in-part of application No. 11/534,724, filed on Sep. 25, 2006, now Pat. No. 7,811,180.

(51) Int. Cl.
*A63B 53/04* (2006.01)

(52) U.S. Cl.
USPC ..... 473/328; 473/335; 473/342; 473/349; 473/350

(58) Field of Classification Search
USPC ..... 473/324–350, 287–292
See application file for complete search history.

(56) References Cited

U.S. PATENT DOCUMENTS 819,900 A * 5/1906 Martin ..... 473/329
3,836,153 A * 9/1974 Dance, Jr. ..... 473/342

(Continued)

OTHER PUBLICATIONS

AAC Web Forum: "Anodizing, What is it?", www.anodizing.org/defintions.html. (downloaded Jun. 26, 2006). 11 pages.

(Continued)

*Primary Examiner* — Sebastiano Passaniti
(74) *Attorney, Agent, or Firm* — Mark S. Leonardo; Brown Rudnick LLP

(57) ABSTRACT

A composite material golf club head is provided having a body made from a first metal and a face insert press fitted to a portion of the body and made from a second metal The metals are chosen so that the first metal is heavier than the second metal. The second metal is disposed towards the front and top of the body, and is preferably hard-anodized. In addition, an interlocking structure, for example rectangular or dove tail shaped channels, is provided in the body so that the face insert becomes embedded in the interlocking structure to anchor the face insert to the body. Portions of the golf club head, such as the face insert or sole plate, are anodized to protect against corrosion. The anodized coating is colored to improve aesthetic characteristics or infused with a polymer to increase or reduce friction.

Disclosed herein is a golf club head having a body portion and a face insert. The front of the body portion further comprises a cutout sized and dimensioned to receive the face insert. The body portion is preferably made from a high-strength metal such as stainless steel, titanium or titanium alloy. The face insert is preferably comprised of a metal having a lower density than that of the body portion. The face insert comprises an aluminum metal matrix composite (MMC) containing an amount of scandium and zirconium. The golf club head may also include a top line insert made of a lightweight material and at least one heavy weight member disposed to the back of the club head.

17 Claims, 11 Drawing Sheets

(56) References Cited

U.S. PATENT DOCUMENTS

| | | | | |
|---|---|---|---|---|
| 3,983,014 | A | 9/1976 | Newman et al. | |
| 4,573,685 | A | 3/1986 | Young, IV et al. | |
| 4,792,140 | A * | 12/1988 | Yamaguchi et al. | 473/331 |
| 4,884,812 | A | 12/1989 | Nagasaki et al. | |
| 5,303,922 | A | 4/1994 | Lo | |
| 5,358,249 | A | 10/1994 | Mendralla | |
| 5,405,136 | A | 4/1995 | Hardman | |
| 5,425,535 | A | 6/1995 | Gee | |
| 5,439,712 | A | 8/1995 | Hattori et al. | |
| 5,489,094 | A | 2/1996 | Pritchett | |
| 5,509,660 | A | 4/1996 | Elmer | |
| 5,616,088 | A | 4/1997 | Aizawa et al. | |
| 5,669,829 | A | 9/1997 | Lin | |
| 5,713,800 | A | 2/1998 | Su | |
| 5,720,673 | A * | 2/1998 | Anderson | 473/342 |
| 5,788,584 | A * | 8/1998 | Parente et al. | 473/290 |
| 5,807,189 | A * | 9/1998 | Martin et al. | 473/342 |
| 5,833,551 | A | 11/1998 | Vincent et al. | |
| 6,030,293 | A * | 2/2000 | Takeda | 473/334 |
| 6,183,381 | B1 * | 2/2001 | Grant et al. | 473/342 |
| 6,200,228 | B1 | 3/2001 | Takeda | |
| 6,238,302 | B1 | 5/2001 | Helmstetter et al. | |
| 6,410,197 | B1 | 6/2002 | Bellino et al. | |
| 6,443,853 | B1 | 9/2002 | Bouquet | |
| 6,443,854 | B1 * | 9/2002 | Calboreanu | 473/324 |
| 6,488,595 | B1 | 12/2002 | Grace | |
| 6,648,773 | B1 | 11/2003 | Evans | |
| 6,679,786 | B2 | 1/2004 | McCabe | |
| 6,739,983 | B2 | 5/2004 | Helmstetter et al. | |
| 6,769,998 | B2 | 8/2004 | Clausen | |
| 6,863,625 | B2 * | 3/2005 | Reyes et al. | 473/342 |
| 6,893,358 | B2 | 5/2005 | Dewanjee et al. | |
| 6,966,846 | B2 | 11/2005 | Bloom, Jr. | |
| 6,971,960 | B2 | 12/2005 | Dewanjee et al. | |
| 6,986,715 | B2 | 1/2006 | Mahaffey | |
| 7,048,648 | B2 | 5/2006 | Breier et al. | |
| 7,060,176 | B2 | 6/2006 | Rasmussen | |
| 7,160,204 | B2 | 1/2007 | Huang | |
| 7,232,380 | B2 | 6/2007 | Nakahara | |
| 7,261,644 | B2 | 8/2007 | Burrows | |
| 7,267,620 | B2 | 9/2007 | Chao et al. | |
| 7,338,387 | B2 | 3/2008 | Nycum et al. | |
| 7,364,513 | B2 | 4/2008 | Krumme | |
| 7,722,479 | B2 | 5/2010 | Soracco | |
| D618,743 | S | 6/2010 | Roach | |
| D618,750 | S | 6/2010 | Roberts | |
| D618,752 | S | 6/2010 | Morris | |
| 7,803,064 | B2 | 9/2010 | Roach | |
| 7,803,068 | B2 | 9/2010 | Clausen | |
| D624,979 | S | 10/2010 | Morris | |
| 7,811,179 | B2 | 10/2010 | Roach et al. | |
| 7,811,180 | B2 | 10/2010 | Roach et al. | |
| 7,819,757 | B2 | 10/2010 | Soracco | |
| 2003/0207726 | A1 * | 11/2003 | Lee | 473/342 |
| 2005/0164800 | A1 * | 7/2005 | Wood et al. | 473/219 |
| 2005/0239576 | A1 | 10/2005 | Stites et al. | |
| 2006/0025235 | A1 | 2/2006 | Nakahara et al. | |
| 2006/0052184 | A1 | 3/2006 | Soracco | |
| 2006/0199661 | A1 * | 9/2006 | Deng et al. | 473/324 |
| 2007/0042836 | A1 | 2/2007 | Best | |
| 2008/0051220 | A1 | 2/2008 | Soracco | |
| 2008/0318705 | A1 | 12/2008 | Clausen | |
| 2009/0118037 | A1 | 5/2009 | Roach | |
| 2009/0221382 | A1 | 9/2009 | Soracco | |
| 2010/0041493 | A1 | 2/2010 | Clausen | |
| 2010/0048318 | A1 | 2/2010 | Clausen | |
| 2010/0056297 | A1 | 3/2010 | Roach | |
| 2010/0069172 | A1 | 3/2010 | Roach | |
| 2010/0151964 | A1 | 6/2010 | Soracco | |
| 2010/0261540 | A1 | 10/2010 | Roach | |
| 2010/0285899 | A1 | 11/2010 | Soracco | |
| 2010/0298065 | A1 | 11/2010 | Soracco | |

OTHER PUBLICATIONS

Alpha Metal Finishing Co.: "About Anodizing", www.alphametal.com/anodizing.htm. Copyright 2000-2002. Downloaded Sep. 30, 2006. 8 pages.

Danford, M.D.: "The Corrosion Protection of 6061-T6 Aluminum by a Polyurethane-Sealed Anodized Coat", NASA Technical Memorandum, NASA TM—100394. Apr. 1990.

Duralectra: "Sanford Hardlube", www.duralectra.com/af/sh.asp. Downloaded Jun. 30, 2006.

Engineers Edge: "Hard Anodizing Finish Specification", www.engineersedge.com/mil_a_8625.htm Copyright 2000-2006. 1 page.

Furukawa-Sky Aluminum Corp.: "Coating and Surface Treatment", www.furukawasky.co.jp/english/produce/en_coating.htm. Downloaded Jun. 26, 2006. 2 pages.

Tiodize Company: "Tiodize Process", http://www.tiodize.com/tiodizeborchurepdf#search=%22titanium%20design%20consideration%20tiodize%20processes%22. Undated 6 pages.

U.S. Appl. No. 12/556,608, filed Sep. 10, 2009.

U.S. Appl. No. 12/570,725, filed Sep. 30, 2009.

U.S. Appl. No. 12/643,154, filed Dec. 21, 2009.

U.S. Appl. No. 12/644,051, filed Dec. 22, 2009.

U.S. Appl. No. 12/694,955, filed Jan. 27, 2010.

U.S. Appl. No. 12/709,679, filed Feb. 22, 2010.

U.S. Appl. No. 12/761,377, filed Apr. 15, 2010.

* cited by examiner

MULTI-METAL GOLF CLUBS

CROSS REFERENCE TO RELATED APPLICATIONS

This application is a continuation of U.S. patent application Ser. No. 11/960,809, filed on Dec. 20, 2007, which is a continuation-in-part of U.S. patent application Ser. No. 11/534,724, filed on Sep. 25, 2006, which are incorporated herein by reference in their entirety.

FIELD OF THE INVENTION

The present invention relates to golf clubs, and more specifically to multi-metal golf clubs.

BACKGROUND OF THE INVENTION

Perimeter weighting in a golf club distributes the mass of the club toward the perimeter, minimizing the effects of off-center hits on the face of the golf club away from the sweet spot and producing more accurate and consistent golf ball trajectories. Perimeter weighting is achieved by creating a cavity in the back of the golf club opposite the face or hitting surface. The material weight saved by creating this cavity is redistributed around the perimeter of the golf club head. In general, larger cavity volumes correspond to increased amounts of mass distributed around the perimeter. Additionally, more of the perimeter weight is moved to the sole of the club to move the center of gravity downward and rearward.

Alternative approaches for moving the center of gravity of a golf club head rearward and downward in the club head utilize composite structures. These composite structures utilize two, three, or more materials that have different physical properties including different densities. By positioning materials that provide the desired strength characteristics with less weight near the crown or top line of a golf club head, a larger percentage of the overall weight of the golf club head is shifted towards the sole of the club head. This results in the center of gravity being moved downward and rearward. This approach is advantageously applicable to muscle back iron clubs or fairway woods, as this will help to generate loft and power behind and below the ball. However, composite materials must be bonded together, for example by welding, swaging, or using bonding agents such as epoxy, and may be subject to delamination or corrosion over time. This component delamination or corrosion results in decreased performance in the golf club head and can lead to club head failure.

Therefore, there remains a need for a composite golf club head that utilizes components having different densities designed in such a way as to minimize the problems associated with delamination, corrosion, or separation of the components.

SUMMARY OF THE INVENTION

The present invention is directed to golf club heads constructed from composite materials. The golf club head includes a body portion, for example a cast or forged body portion, made from a first metal to which is attached a face insert made from a second metal. The first and second metals are selected so that the first metal has a higher density than the second metal. An example of suitable metals includes titanium or steel for the first metal and aluminum for the second metal. The face insert is positioned on the front of the body portion adjacent the top line (or crown) and forms at least a portion of the hitting surface of the club head. In order to minimize delamination or separation between the body and the face insert, an interlocking structure is preferably formed in the body portion and arranged to interlock with the face insert when the face insert is fitted onto the body portion. This interlocking structure includes one or more channels running through the top section of the body portion to which the face insert is attached. Upon attachment, the face insert is interlocked with the channels, providing sufficient and stable attachment between the face insert and the body portion. The channel is shaped to further enhance the connection between the two components. These shapes include, but are not limited to, rectangular cross sections and cross sections having overhangs such as dove tail cross-sections. The present invention is also directed at anodizing at least one part of the golf club head, preferably the face insert. In an alternative embodiment, all the components of the club head are anodized. The face insert, the body of the club head or both can be anodized. For example, the face insert can be made from an anodized aluminum, or the body portion can be made from anodized titanium, or both. A polymer such as PTFE, polyurethane or polyurea can be added to the anodized layer to enhance the performance of the clubs.

An embodiment of the present invention teaches a golf club head having a body portion and a face insert. The front of the body portion further comprises a cutout designed to receive the face insert. The body portion is preferably comprised of a high-strength metal such as stainless steel, titanium or titanium alloy. The face insert is preferably comprised of a metal having a lower density than that of the body portion. More preferably, the face insert comprises an aluminum metal matrix composite (MMC). The face insert preferably has a plurality of feet to be cold worked into a pocket in the cutout. The feet may have notches or angled surfaces to facilitate their bending into the pocket.

The golf club head of the present invention may also include an insert disposed to the top line, said insert comprising a lightweight material. Additionally, the golf club head may include at least one weight member disposed to the back, located behind and below the center of gravity of the club head.

DETAILED DESCRIPTION

Figure 1:
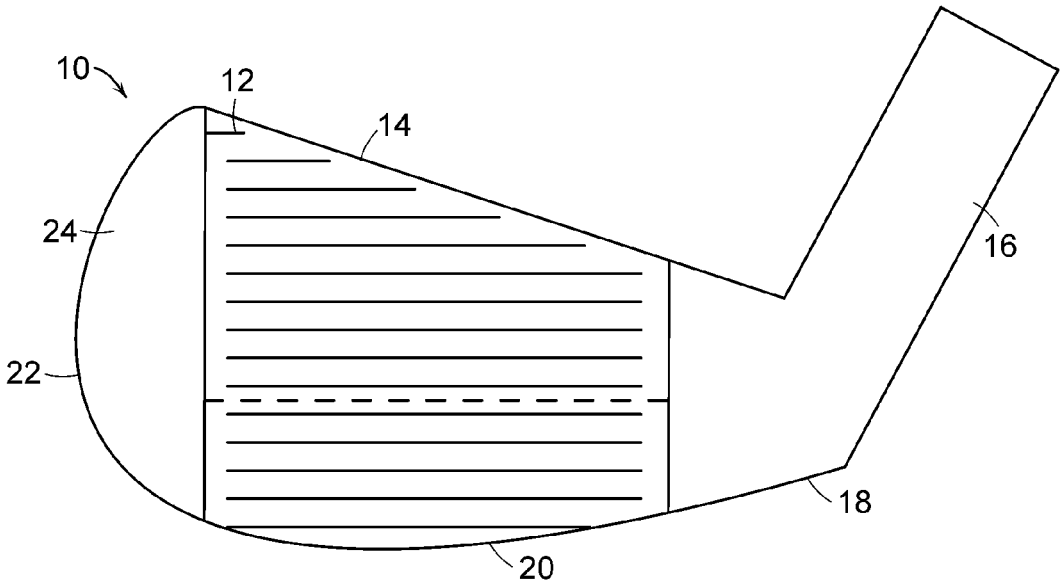
FIG. 1 is a front view of an embodiment of a golf club head in accordance with the present invention.
Figure 2:
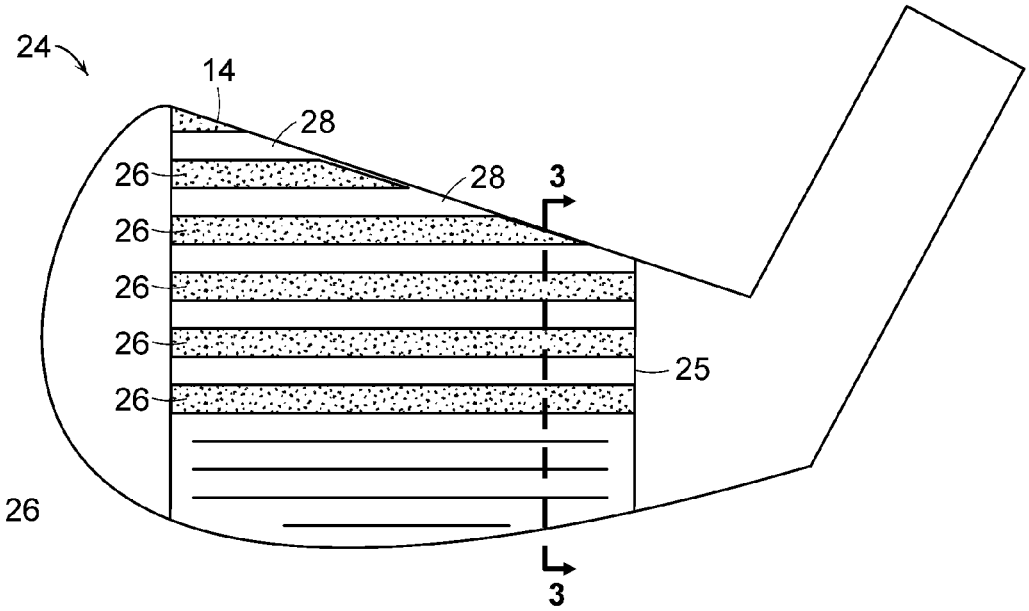
FIG. 2 is a front view of an embodiment of a body portion without the face insert of the present invention.
Figure 4:
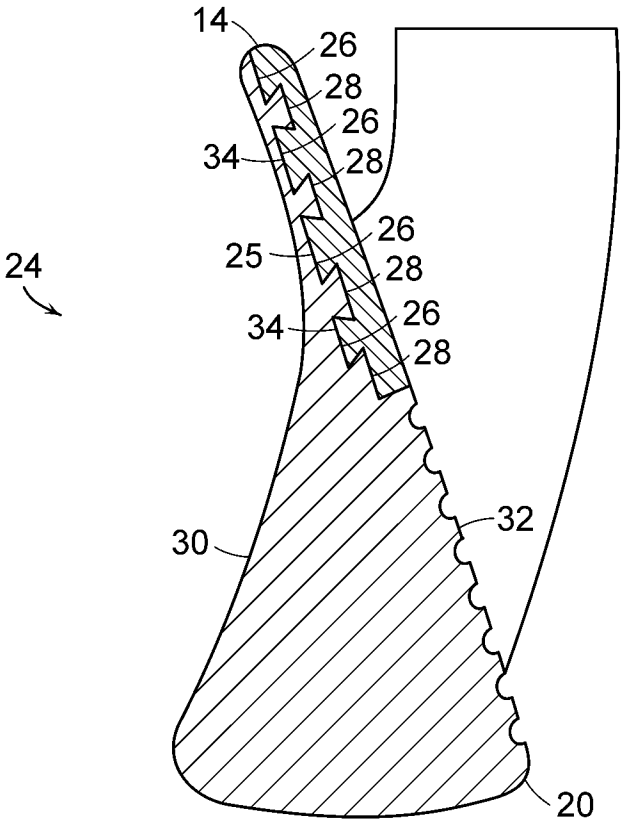
FIG. 4 is a cross-section view of the body portion showing another embodiment of the interlocking structure of the present invention.

Referring now to the accompanying FIGS. 1-7, exemplary embodiments of the golf club head 10 in accordance with the present invention include face insert 12 and body portion 24, which is attached to hosel 16. Hosel 16 is adapted to receive a shaft (not shown). Club head 10 is preferably cast or forged from suitable material such as stainless steel, carbon steel, or titanium. In one embodiment, body portion 24 is a cast body portion. Body portion 24 includes crown or top line 14, toe 22, sole 20 and heel 18 that form the perimeter of body portion 24. Hosel 16 extends generally from heel 18 of body portion 24. In one embodiment, club head 10 is arranged as muscle-back iron-type club head that has a thicker bottom back portion. Body portion 24 also includes front 32 forming the hitting surface.

Improvement in the location of the center of gravity of golf club heads in accordance with the present invention is achieved through the use of a composite construction that utilizes various materials having varying weights or densities. In particular, golf club head 10 utilizes two materials. Body portion 24 is constructed of a first material, for example a first metal, having a first weight or density. Suitable materials for the body portion 24 include, but are not limited to, stainless steel, carbon steel, beryllium copper, titanium and metal matrix composites (MMC). Preferably, body portion 24 is made from a higher density metal such as stainless steel or titanium. Club head 10 also includes face insert 12 attached to front 32 of body portion 24. Face insert 12 is constructed of a second material, i.e., a second metal having a second density. Suitable materials for face insert 12 include titanium, aluminum and alloys thereof. In one embodiment, the first weight or the first density is greater than the second weight or second density.

In order to move the center of gravity of club head 10 downward and to the rear, lightweight face insert 12 is attached to body portion 24 so that face insert 12 is disposed on front 32 of body portion 24 adjacent crown or top line 14. Therefore, face insert 12 forms a part of the club face or hitting surface of club head 10. To minimize delamination of face insert 12 from body portion 24, body portion 24 includes interlocking structure 25 formed on at least a portion of front 32 of body portion 24 adjacent top line 14. When face insert 12 is attached to or press fit on front 32 of body portion 24, face insert 12 is secured and anchored in interlocking structure 25. Optionally, adhesives, welds or other bonding agents can be used to help secure face insert 12 into interlocking structure 25. The interaction and meshing of face insert 12 with interlocking structure 25 is sufficient to fixedly secure face insert 12 to body portion 24.

In one embodiment, interlocking structure 25 contains at least one channel 26 running through a top of front 32 of body portion 24. Alternatively, a plurality of parallel channels 26 are formed in front 32 of body portion 24, further defining a plurality of associated ridges or raised portions 28. In one embodiment, the plurality of parallel channels 26 are arranged substantially parallel to top line 14 or sole 20 of body portion 24. In one embodiment, face insert 12 is pressed onto body portion 24, such that the second metal of face insert 12 substantially fills each channel 26 when face insert 12 is attached to body portion 24. Although channel 26 can be arranged as any shape including curves and annular shapes, preferably, channel 26 is a generally rectilinear line arranged parallel to sole 20.

Figure 3:
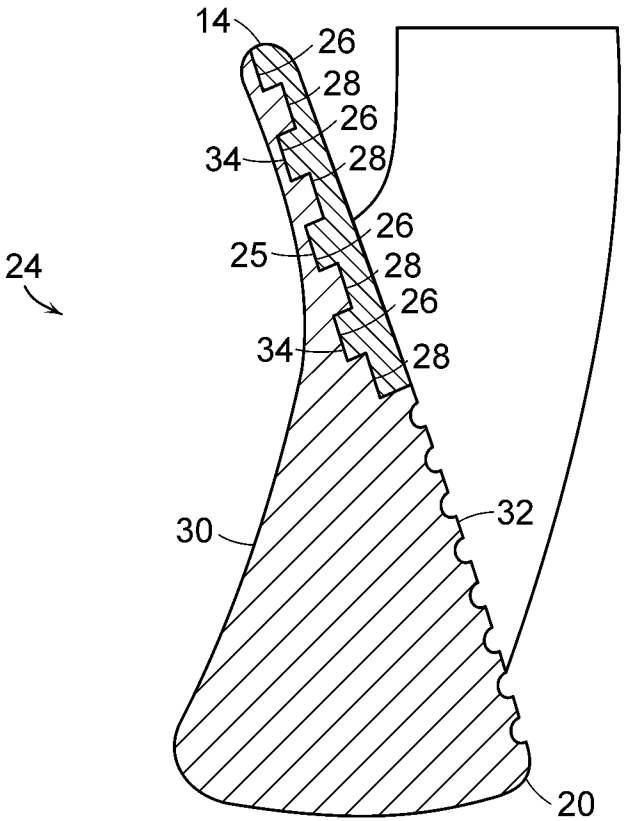
FIG. 3 is a view through line 3-3 of FIG. 2.
Figure 6:
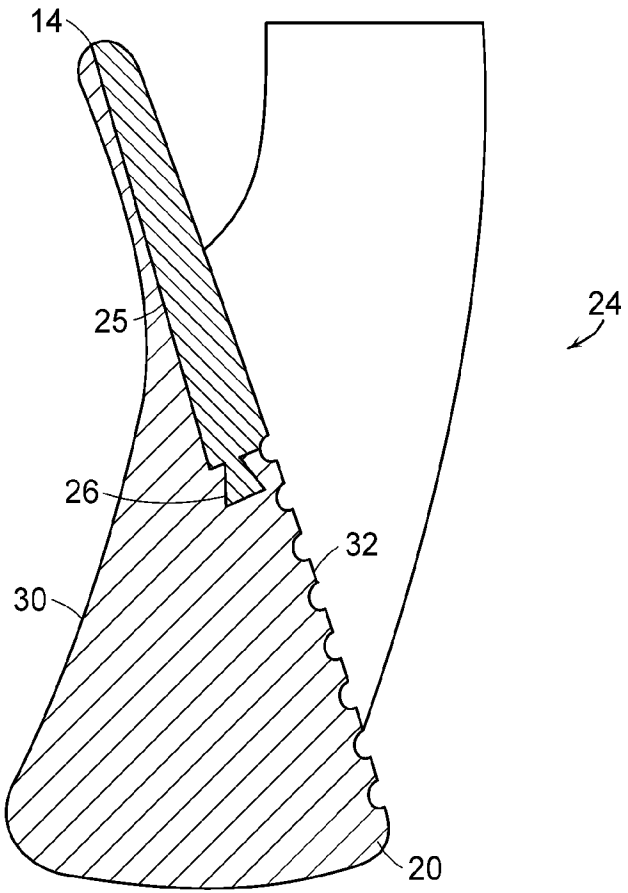
FIG. 6 is a cross-section of the body portion showing another embodiment of the interlocking structure of the present invention.
Figure 5:
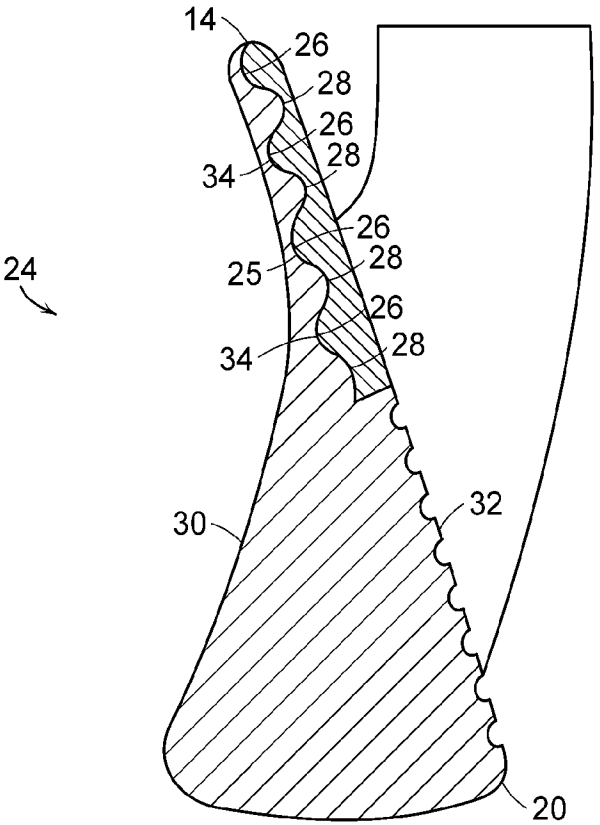
FIG. 5 is a cross-section of the body portion showing another embodiment of the interlocking structure of the present invention.

By embedding face insert 12 in interlocking member 25 having channel 26, a stronger more resilient bond is formed between face insert 12 and body portion 24. Depending on the shape, and in particular the profile in cross section, of the channel, both increased surface area contact and increased mechanical binding is achieved between body portion 24 and face insert 12 when press fit together. In one embodiment as illustrated in FIG. 3, each channel has a generally rectangular cross section. In another embodiment, at least one and preferably two undercuts 34 (FIG. 4) are provided in each channel. Undercut 34 is formed by making channel 26 narrow as it approaches its open end. In one embodiment, channel 26 has a dove tail shaped cross section. Alternatively, channel 26 has a generally rounded cross section (FIG. 5), for example circular or oval. Also ridge portion 28 can be rounded or curved outward to facilitate easier engagement between face insert 12 and body portion 24 when the two components are press fit together. Although in these embodiments, each channel 26 opens toward front 32 of body portion 24, other arrangements are also possible. For example, as illustrated in FIG. 6, channel 26 can open towards crown or top line 14 of body portion 24. Preferably, channel 26 has a dove tail shaped cross section in this embodiment. Face insert 26 will become embedded in this upwardly opening channel when attached to body portion 24, preferably with adhesives.

Figure 7:
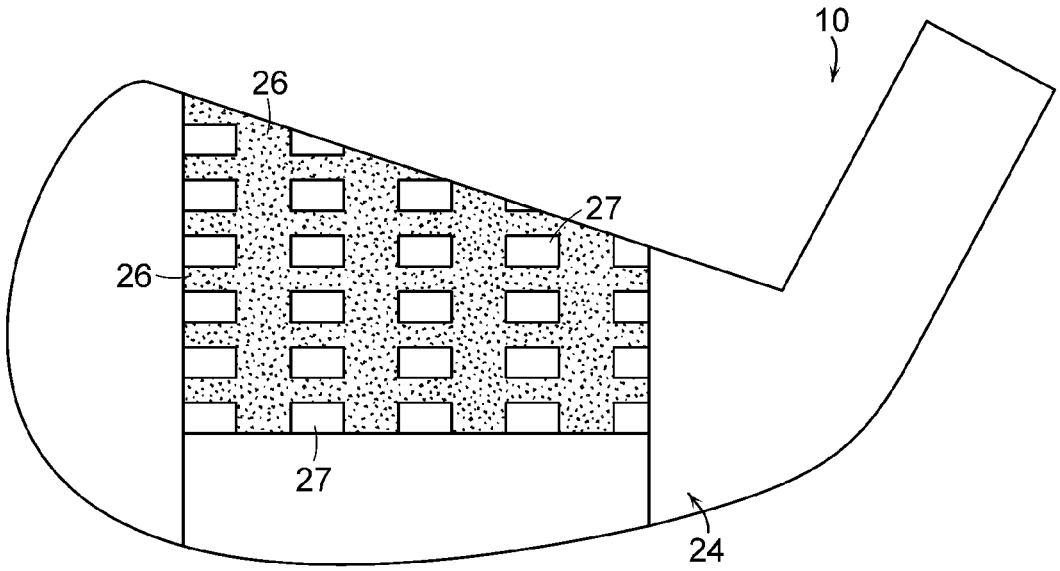
FIG. 7 is another embodiment of FIG. 2.

In another embodiment, interlocking member 25 comprises a plurality of upstanding posts 27 formed by intersecting channels 26, e.g., one set of horizontal channels 26 and another set of vertical channels 26 as shown in FIG. 7. Face insert 12 can be hammered or pressed onto body portion 24, for example by swaging or cold-forging. This method can also be used with the embodiments shown in FIGS. 4 and 5.

In one embodiment, in order to form the interlocking structure on the front of the body portion, at least one channel is formed that runs through the portion of the front of the case body. Alternatively, a plurality of parallel channels is formed in the front of the body such that each channel is parallel to at least one of the top lines or the sole of the body portion. The channel can be formed to have a generally rectangular cross section. Alternatively, the channel is formed to have a dove tail shaped cross section. Having formed the interlocking structure in the front of the body, the face insert is pressed onto the front of the cast body to secure a portion of the face insert in the interlocking structure.

Exemplary embodiments in accordance with the present invention include a method for making a golf club head by forming an interlocking structure on at least a portion of the front of the body portion of golf club head adjacent a top line thereof. As was described above, the body includes the top line, sole, toe, heel, front and back opposite the front opposite, and the body is made from a first metal. A face insert is attached to the front of the cast body by securing a portion of the face insert in the interlocking structure of the body. The face insert is constructed of a second metal. The first and second metals are selected such that the first metal has a greater density or weight than the second metal. For example, the first metal is selected to be titanium or a titanium alloy, and the second metal is selected to be aluminum or an aluminum alloy. The face insert 12 can occupy between 10% and 40% of the volume of the club head.

Low-density, high-strength alloys such as those made from aluminum are particularly suitable for the present invention. The following table illustrates the masses and thickness of corresponding typical face inserts for iron-type golf clubs:

| Face Insert Material | Typical Face Insert Thickness | Approx. Mass of Face Insert |
|---|---|---|
| High Strength Steel | 0.090 in. | 50 g |
| Titanium | 0.120 in. | 40 g |
| High Strength Aluminum | 0.140 in. | 30 g |

The differences in the thickness of the face inserts for the different materials are necessary due to the varying material strengths; these face inserts have substantially similar strengths. Of the three materials, steel is the strongest, and thus can have the thinnest face, but it has a higher density than both aluminum and titanium. Consequently, even a thinner steel face has a mass greater than either of the titanium or high-strength aluminum faces. Furthermore, the high-strength aluminum face insert's low density allows more mass to be redistributed for an improved center of gravity location and size of the sweet spot.

When a low-density metal such as a high-strength aluminum alloy is used for a face insert, it should be an alloy with suitable material strength and mechanical properties such as yield strength, tensile strength, hardness, elongation, etc., to avoid club failure or performance deterioration. Preferably, a high-strength aluminum alloy such as an alloy containing Scandium and 7-series high strength aluminum alloy ("Sc-7") or an aluminum alloy containing a percentage of ceramic ("M5C") is used. Material properties for these alloys, as well as suitable alloys MMC-7 and 13A, are listed in the table below.

| | Alloy: | | | |
|---|---|---|---|---|
| | MMC-7 | Sc-7 | 13A | M5C |
| Al Series: | 7xxx | 7xxx | 6xxx | 5xxx |
| Chemical Composition: | Al—1.5Mg—4.0Zn + 6SiC | Al—1.5Mg—4.0Zn + Sc | Al—0.9Mg + Sc | Al—5.0Mg + ceramic (approx 0.8%) |
| Hardness: | 56 HRB | 81 HRB | 80 HRB | 65 HRB |
| Tensile Strength: | 49 ksi | 70 Ksi | 62 ksi | 51 ksi |
| Yield Strength: | 45 ksi | 62 ksi | 54 ksi | 37 ksi |
| Elongation: | 11% | 10% | 11% | 14% |
| Face thickness preferred: | 3.2 mm (0.1260 in.) | 3.2 mm (0.1260 in.) | 3.2 mm (0.1260 in.) | 3.5 mm (0.1378 in.) |

However, aluminum alloys, including high-strength aluminum alloys such as Sc-7 and M5C, can be susceptible to corrosion, and in some cases more than traditional stainless steel or titanium materials. When aluminum alloys are in contact with steel alloys, galvanic corrosion can also adversely affect the aluminum.

In accordance with an embodiment of the present invention, the metals of the inventive golf club are oxidized, more preferably anodized, to improve its strength and corrosion resistance. Oxidation of many untreated metals such as aluminum occurs naturally as the metal undergoes prolonged contact with air. Anodization is a process used to modify the surface of a metal, and it produces a much more uniform, more dense, and harder oxidation layer than what is formed by natural oxidation. It can be used to protect the metal from abrasion or corrosion, create a different surface topography, alter the crystal structure, or even color the metal surface. During anodization, a chemical reaction occurs, producing an oxide layer bonded to the surface of the metal. For example, to anodize an aluminum or aluminum alloy object, the object is first pre-treated by an ordinary degreasing. Then the surface is freed of scratches or existing oxides, preferably by an etching process. The object is submerged in a chromic acid or more preferably a sulfuric acid solution. Next, an aluminum oxide layer is made on the object by passing a DC current through the chromic acid or sulfuric acid solution, with the aluminum object serving as the anode. The current releases hydrogen at the cathode and oxygen at the surface of the aluminum anode, creating a buildup of aluminum oxide. Anodizing at 12 volts DC, a piece of aluminum with an area of about 15.5 square inches can consume roughly 1 ampere of current. In commercial applications the voltage used is usually in the range of about 15 to 21 volts. Conditions such as acid concentration, solution temperature and current are controlled to allow the formation of a consistent oxide layer, which can be many times thicker than would otherwise be formed. This oxide layer increases both the hardness and the corrosion resistance of the aluminum surface. The oxide forms as microscopic hexagonal "pipe" crystals of corundum, each having a central hexagonal pore, which is also the reason that an anodized part can take on color in the dyeing process.

Following the formation of a satisfactory oxide coating, the anodized object is often sealed to maximize the degree of abrasion resistance. Sealing can be accomplished by immersing the object in a sealing medium, such as a 5% aqueous solution of sodium or potassium chromate (pH 5.0 to 6.0) for 15 minutes at a temperature from about 90° C. to 100° C., boiling de-ionized water, cobalt or nickel acetate, or other suitable chemical solutions.

Different types of anodizing, Type I, II, and III, are explained in MIL-Spec MIL-A-8625F (Anodic Coatings for Aluminum and Aluminum Alloys), which is hereby incorporated by reference. Most preferably, the face insert is hard-anodized with a Type III coating according to MIL-A-8625F. This hard anodic coating is thicker than standard Type I or Type II anodic coatings by up to 0.0035 inches, and penetrates deeper within the coated metal than standard Type I or Type II anodic coatings. The following table from MIL-A-8625F shows the common thickness ranges among the types of anodic coatings.

| Coating Type | Thickness Range (Inches) |
|---|---|
| Type I, IB, IC, IIB | 0.00002 to 0.0007 |
| Type II | 0.00007 to 0.0010 |
| Type III | 0.0005 to 0.0045 |

Commercial examples of Type III-compliant anodizing processes include the Sanford Hardcoat® process by Duralectra of Natick, Mass. and hardcoat anodizing done by Alpha Metal Finishing Co. of Dexter, Mich., both of which are hereby incorporated by reference. The Type III hard-anodizing process is similar to Type I and II processes, but Type III uses a sulfuric acid bath at a lower temperature, approaching 0° C., as well higher currents. In accordance with MIL-A-8625F, Type III coatings are generally not applied to aluminum alloys having a nominal copper content in excess of 5% or nominal silicon content in excess of 8%. Alloys which have a porosity of greater than about 5% less preferred for Type III coatings. In addition, Because Type III coatings have increased abrasion resistance, sealing or infusing the coating with a polymer in the same manner as Type I and II, as discussed in more detail below, is not required, and the coating can remain somewhat porous. Furthermore, having a porous unsealed structure allows the hard-anodic coating to be infused with a colored dye to change the appearance of the object, or a polymer such as polytetrafluoroethylene (PTEE) or a polyepoxide (epoxy) or polyurethane-based resin to adjust the frictional characteristics of the object.

A method for infusing a hard-anodic coating with a polymer is disclosed in U.S. Pat. No. 5,439,712 to Hattori et al. entitled "Method for Making a Composite Aluminum Article," the entirety of which is hereby incorporated by reference. Once the hard-anodization process is complete, the anodized object is immersed in an infusion solution. This infusion solution contains positively-charged polymer particles dispersed into the solution using a nonionic active agent. The solution and the aluminum object are heated to a temperature ranging from 40° C. to 80° C., and a voltage of 2 to 10 volts is applied. The aluminum object acts as an anode, and the positively-charged polymer particles become absorbed into the hard anodic coating to form a uniform monomolecular layer. As can be appreciated by those skilled in the art, any positively-charged polymer particles can be used, and depending upon the type of alloy or polymer that is used, the temperature and voltage may vary.

Figure 8:
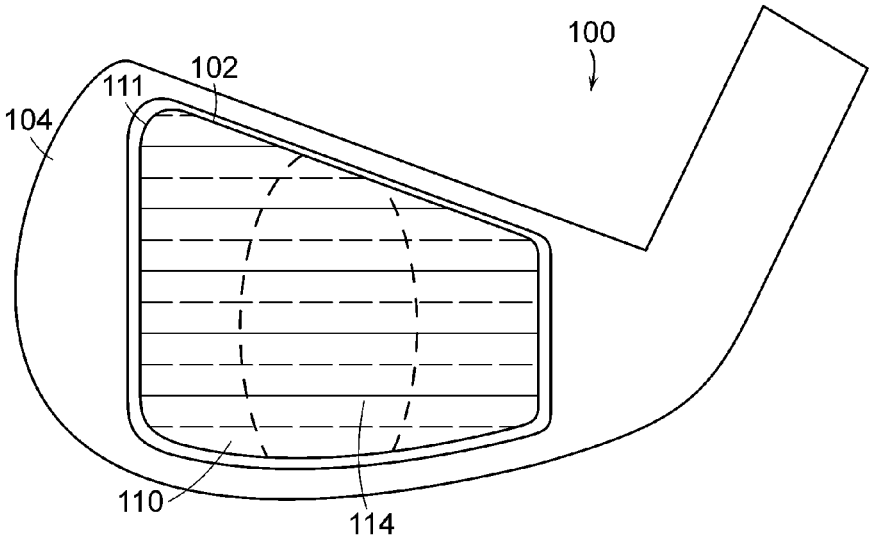
FIG. 8 is a front view of an embodiment of a club head of the present invention.
Figure 9:
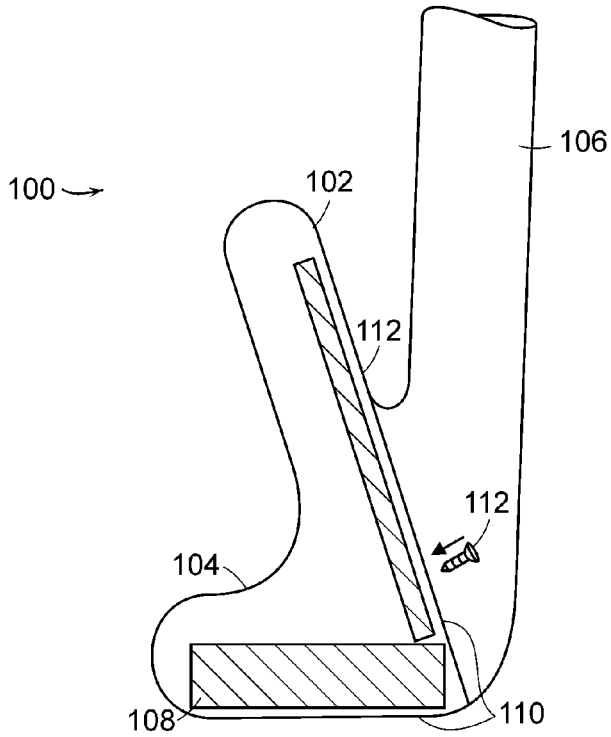
FIG. 9 is a cross-sectional view of an embodiment of a club head of the present invention.
Figure 9B:
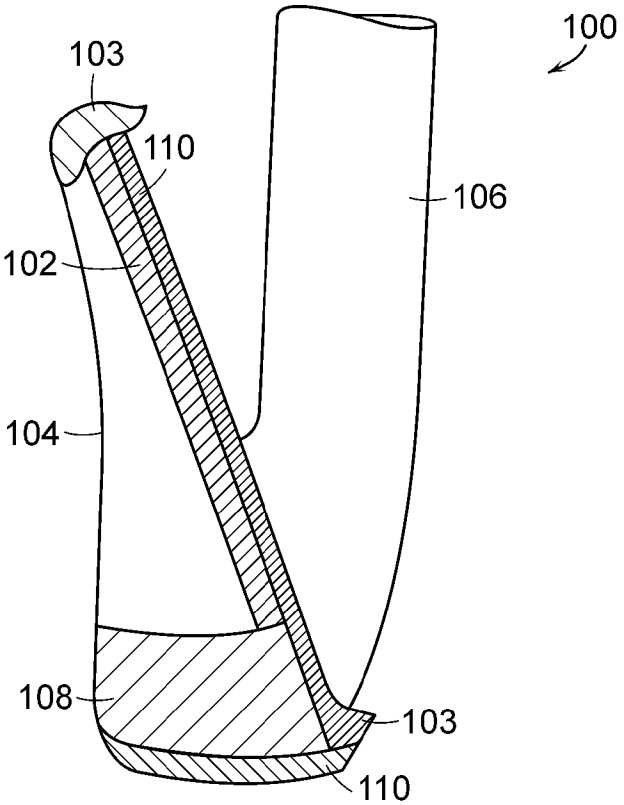
FIG. 9B is a cross-sectional view of another embodiment of a club head of the present invention.

FIGS. 8 and 9 show an embodiment of the present invention, with face insert 102 attached to body 104 of club head 100. Face insert 102 is preferably hard-anodized, i.e., Type III, before attachment so that it is coated with hard-anodic coating 110. After the face insert is hard-anodized, it is preferably attached to the body of the club head via a resin 111 such as epoxy or urethane, with the perimeter of face insert 102 supported on the reverse side by a ledge (not shown) that is part of club head body 104. However, various other methods of attachment may be envisioned by those skilled in the art, including the attachment methods mentioned in previous embodiments. Other methods of attachment include, but are not limited to, using screws 112 as shown in FIG. 9, or cold-forging or swaging a portion 103 of body 104 over face insert 102 shown in FIG. 9B to retain face 102. Insert 102 may have a thin ledge around its periphery sized and dimensioned to receive portion 103, so that the hitting face is flat. In addition, it may be advantageous to drill larger than normal holes in face insert 102 for screws 112, as coating 110 will fill in some of the area during the anodizing process, or else use smaller sized screws.

Although hard-anodic coatings are often uncolored, gray, or clear, the face insert may be hard-anodized with a colored or dyed coating to create an improved aesthetic effect. The Sanford Hardcoat® process by Duralectra mentioned above has the capability of applying a hard-anodic coat with color to aluminum. Coloring can also be accomplished through a two-step electrolytic method, an integral coloring process which combines anodizing and coloring, organic or inorganic dyeing through polymer infusion as mentioned above, interference coloring, etc. Such a colored coating could be used to effectively outline or shade a hitting area or "sweet spot" on the club head. Sweet spot 114 in FIG. 8 is an example of such a colored region on the face insert. Coloring only a portion of an object can be done by masking the parts of the object that are not to be anodized with a protective coating mask. Such a coating or masking is often made from vinyl or other polymers and is usually made to be easily applied and removed. A commercially available peelable mask appropriate for hard-anodizing procedures is the PlateOff Mask 4210, available from General Chemical Corp. of Detroit, Mich.

Figure 9A:
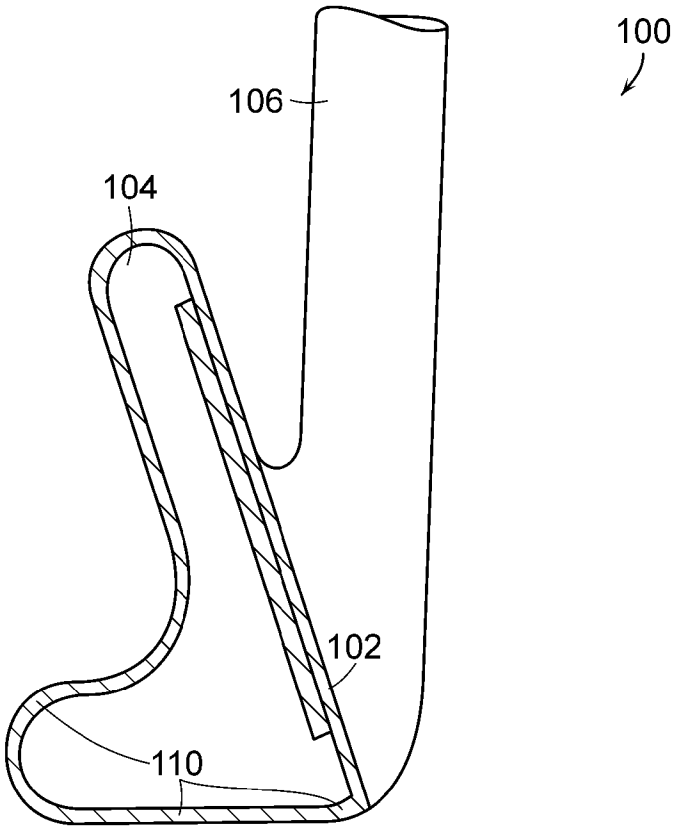
FIG. 9A is a cross-sectional view of another embodiment of a club head of the present invention.

The present invention is not limited to examples wherein only the face insert is hard-anodized. Although face insert 102 is preferably constructed from a lighter, less dense material than club head body 104, it is possible to attach the face insert to club head body 104 prior to the anodization process. As shown in FIG. 9A, once face insert 102 is attached, then the entire club head 100, including body 104 and face insert 102, may be substantially coated by hard-anodic coating 110. This is especially preferable when face insert 102 is made from aluminum or aluminum alloy, and when club head body 104 is made from titanium or titanium alloy, as these materials may easily be anodized. Whereas aluminum is anodized according to MIL-A-8625F, titanium is anodized according to AMS-2488 or MIS-23545, both of which are hereby incorporated by reference. The Tiodize® Company of Huntington Beach, Calif. processes titanium and titanium alloys according to these specifications under the name of the Tiodize® Processes, all of which are hereby incorporated by reference. The Tiodize® Company produces a brochure titled "Tiodize Process" explaining their processes, which is also hereby incorporated by reference. Titanium is generally anodized in a similar manner as aluminum, by immersing a titanium object in a solution and running an electric current through the solution. However, titanium is typically immersed in an alkaline solution at room temperature, unlike aluminum and its alloys. Although the processes for anodization of aluminum and titanium are not the same, masking may be done during the counterpart anodizing process to avoid interference between the coatings or metals. This embodiment also provides club designers with a wider range of options for attachment methods than if face insert 102 is hard-anodized prior to attachment to club head body 104 to minimize any possible damage to the hard-anodic coating 110 during the attachment process when body 104 and insert 102 have been connected prior to anodization.

Figure 11:
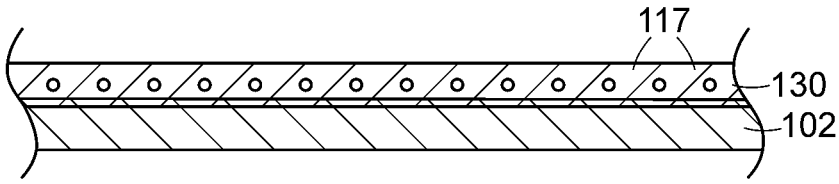
FIG. 11 is a cross-sectional view of an infused hard-anodic coating applied to a face insert according to the present invention.
Figure 12:
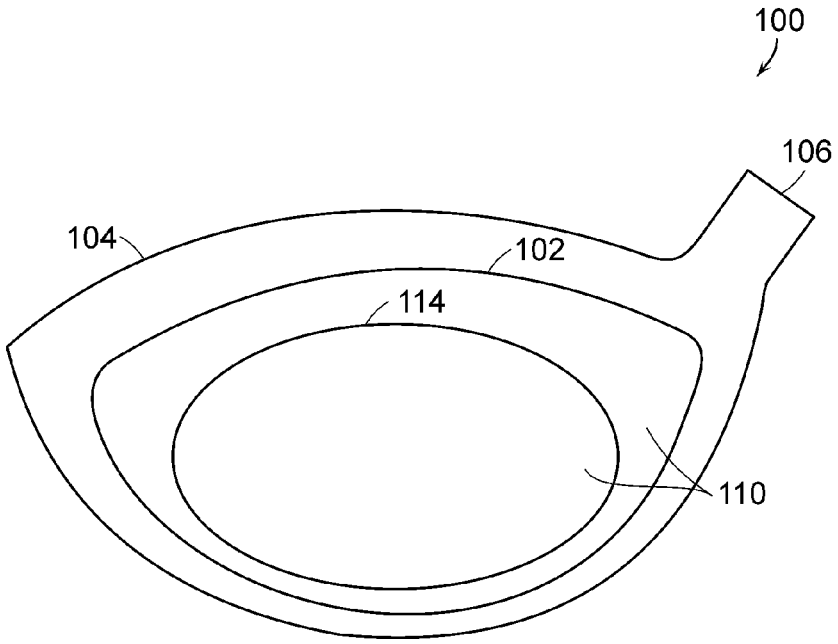
FIG. 12 is a front view of an embodiment of a driver-type club head of the present invention.
Figure 13:
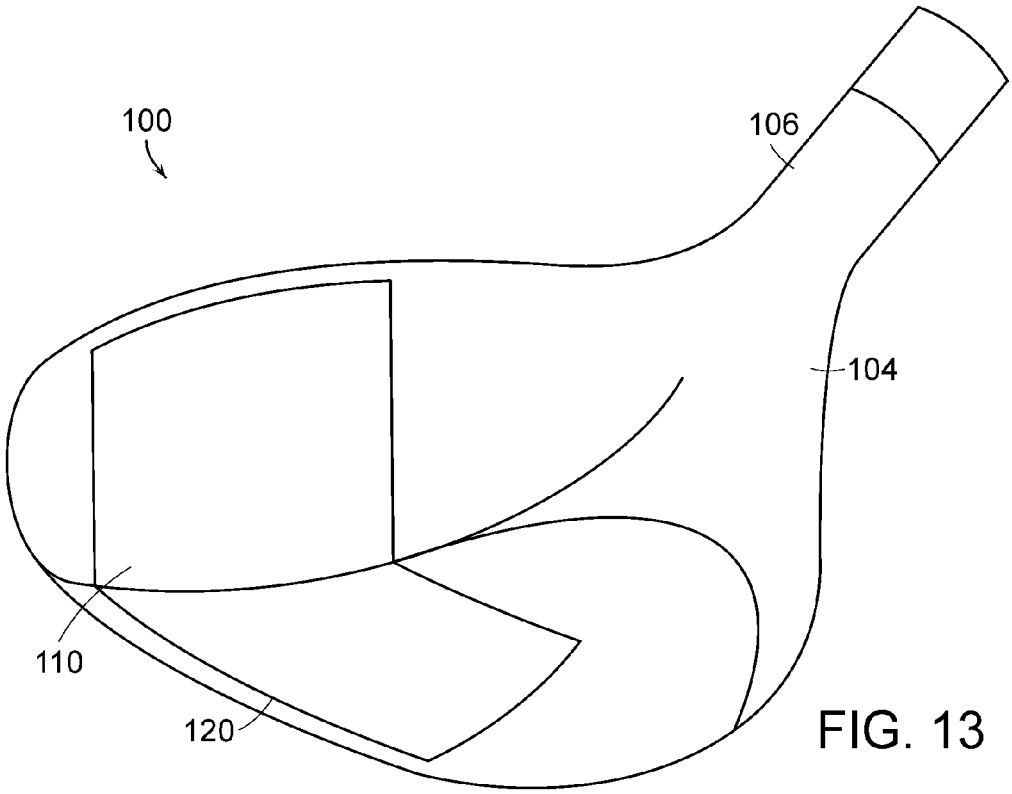
FIG. 13 is a perspective view of another embodiment of a driver-type club head of the present invention.

In yet another embodiment, as shown in FIG. 11, a hard-anodic coating may be infused or impregnated with a polymer 117, preferably a fluorinated polymer such as polytetrafluoroethylene (PTFE), commonly known and available as Teflon® from DuPont, to form low-friction coating 130. Such a process is commercially available as the Sanford Hardlube® process by Duralectra, which is hereby incorporated by reference. The anodized object is immersed in a solution that contains positive PTFE ions and an electrical current is applied. The positive ions become attracted to the object, which acts as an anode, and become infused into the pores of low-friction coating 130. Impregnating the hard-anodic coating with PTFE is especially advantageous when low-friction coating 130 is applied to the faces of golf clubs such as drivers or fairway woods, shown in FIGS. 12-13, where reduced spin is desired, because PTFE has one of the lowest known coefficients of friction.

Figure 10:
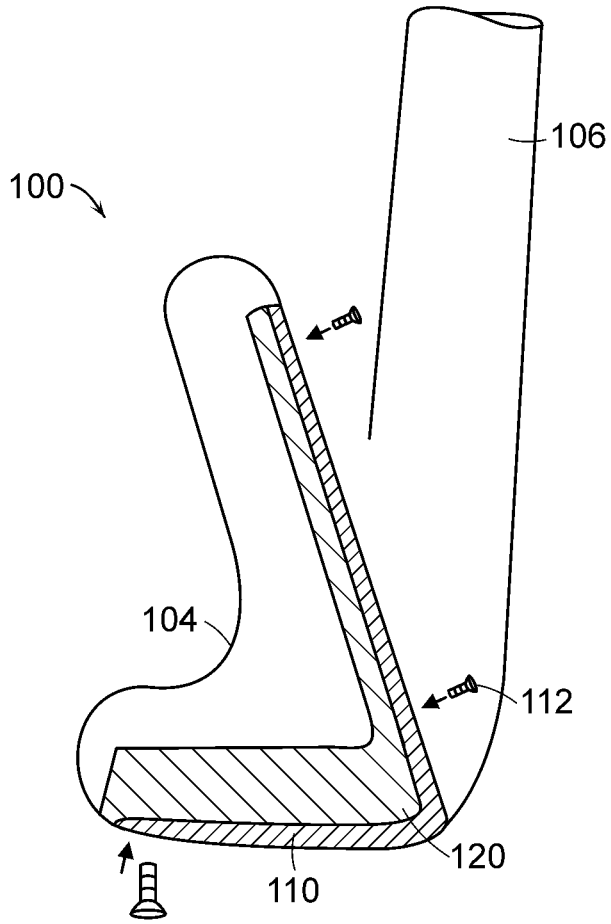
FIG. 10 is a cross-sectional view of another embodiment of a club head of the present invention.

An optional sole plate 108 may be hard-anodized with regular hard-anodic coating 110 or with a low-friction coating 130 impregnated by a polymer such as PTFE, the latter of which provides a further benefit in fairway woods in that the club will have more protection and encounter less friction when sole plate 108 makes contact with the ground, increasing swing speed and club longevity. The hard-anodic sole plate 108 is also advantageous as applicable to drivers, especially when hitting off a standard plastic driving range mat, due to the reduced friction and extra protection provided by the PTFE-infused coating. This is further applicable to iron-type club heads (as shown in FIG. 9) or putter clubs. As shown in FIG. 10, in an alternative to a separate sole plate 108, a unitary face/sole piece 120 may be provided by the current invention, with said unitary piece 120 preferably being hard-anodized with a low-friction coating 130 infused with PTFE. Unitary piece 120 may act to provide much of the same benefits of the separate inventive face insert and sole plate as seen in previous embodiments, but adds further protection and reduced friction to the lower portion of the club head 100.

Figure 11A:
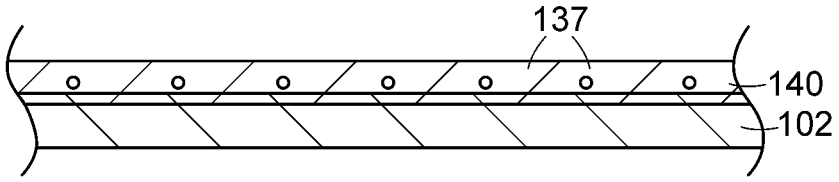
FIG. 11A is a cross-sectional view of another infused hard-anodic coating applied to a face insert according to the present invention.

As shown in FIG. 11A, in another embodiment, when increased spin is desired, i.e., in iron-type clubs, the hard anodic coating over the face insert 102 may be sealed with a higher-friction polymer material 137 such as an epoxy-based resin, polyurethane, or polyurea to become hard-anodize increased-friction coating 140. This is advantageous for highly skilled golfers who desire increased control of the ball when hitting approach shots into greens, because it will increase the friction between the ball and face insert 102, allowing more control and "workability" for whatever type of shot is desired. The process for infusing the coating with high-friction polymers is similar to the process used for PTFE above. The anodized object is immersed in a solution that contains positive polymer ions and an electrical current is applied. The positive ions become attracted to the object, which acts as an anode, and become infused into the pores of increased-friction coating 140, sealing the structure. In one example, selected iron-type clubs from a set, such as the short irons and wedges, are constructed with increased-friction coating 140 to increase ball spin and control to the short game.

Figure 14A:
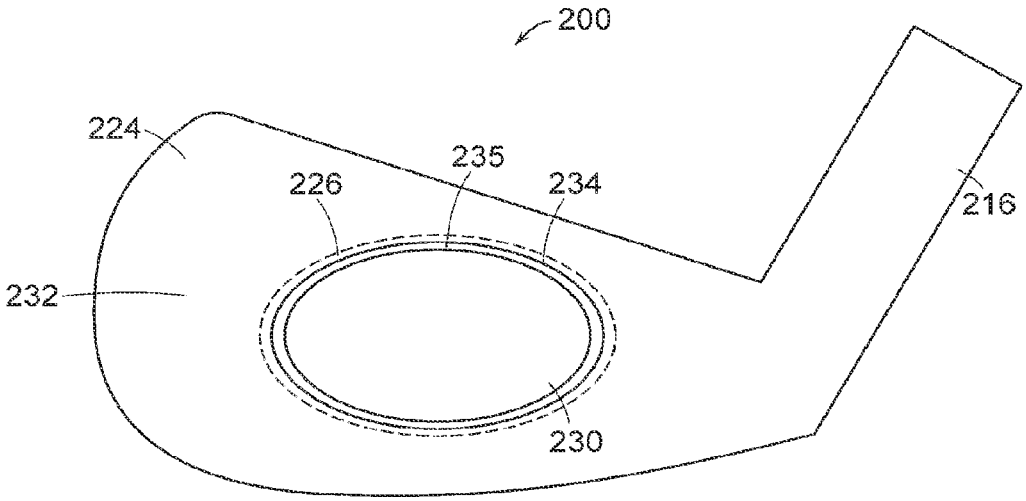
FIG. 14A is a front plan view of a golf club head of the present invention, shown without a face insert.
Figure 16:
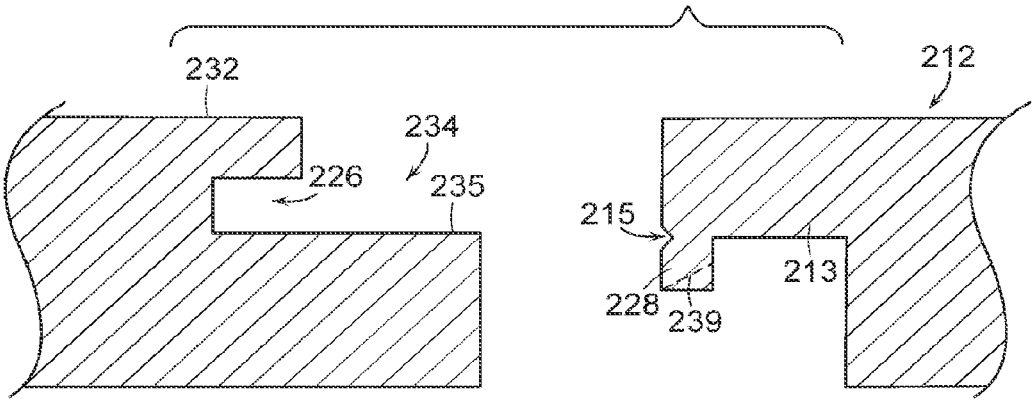
FIG. 16 is a cross-sectional view of a portion of the front of a golf club head and a portion of a face insert of the present invention.

Another embodiment of the present invention is shown in FIGS. 14A-16. Golf club head 200 comprises hosel 216, body portion 224 and face insert 212. Body portion 224 includes a crown, a skirt, a sole and front 232 having cutout 230, sized and dimensioned to receive face insert 212. Cutout 230 can further comprise stepped edge 234 and pocket 226. Stepped edge 234 comprises a lower ledge 235 positioned between 3.0 and 5.0 millimeters below the surface of front 232, as shown in FIG. 14A. More preferably, lower ledge 235 is positioned between 3.5 and 4.0 millimeters below the surface of front 232. Pocket 226 is preferably machined into front 232 around the circumference of stepped edge 234 and underneath front 232, so that their openings are not visible from a front plan view of the golf club head. Face insert 212 has upper ledge 213 adapted to be received on top of lower ledge 235 on stepped edge 234, as best shown in FIG. 16.

Figure 14B:
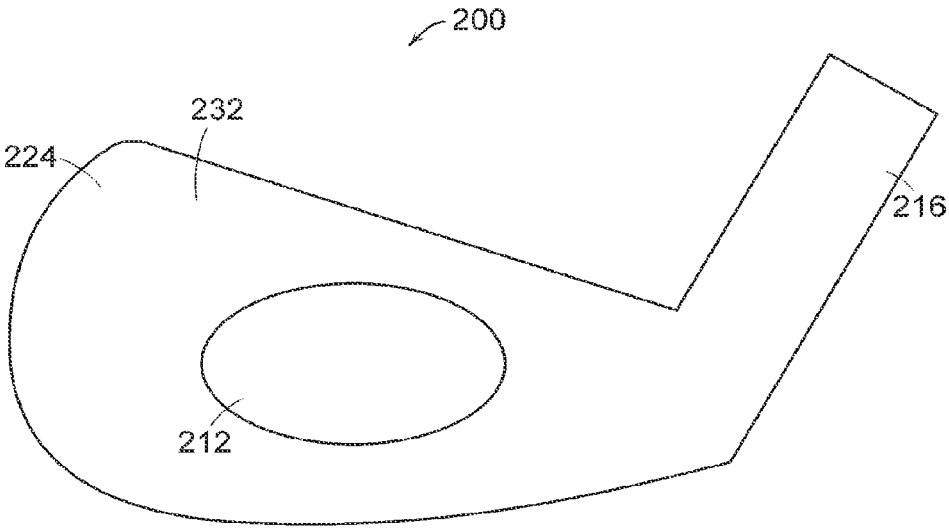
FIG. 14B is a front plan view of the golf club head of FIG. 14A, shown with a face insert.
Figure 15A:
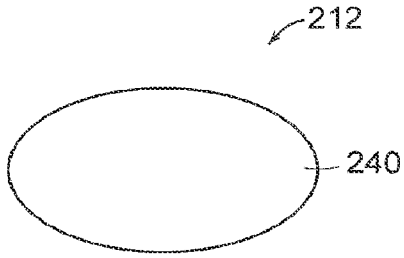
FIGS. 15A and 15B are a top plan and bottom plan views, respectively, of a face insert of the present invention.
Figure 15B:
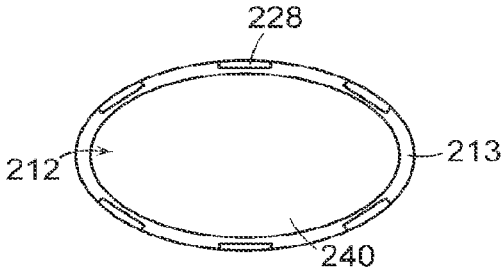

In accordance with this embodiment, face insert 212 is attached to front 232 at cutout 230 so that the top surface of face insert 212 is flush with the surface of front 232. Preferably, the thickness of face insert 212 is substantially the same as the thickness of front 232. To retain face insert 212 to front 232, upper ledge 213 and feet 228 of face insert 212 rest on lower ledge 235 of stepped edge 234 and feet 228 are inserted into pocket 226. As shown in FIG. 16, feet 228 are positioned substantially downward and pocket 226 is oriented substantially sideways. To ensure proper attachment, feet 228 are at least partially plastically deformed into pocket 226. Optionally, some residual elasticity in feet 228 after being bent can ensure a tight fit. To assist the bending of feet 228 in the proper direction, feet 228 can be initially oriented outward toward pocket 226 (not shown). Alternatively, to assist in the outward bending of feet 228 notch(es) 215 or other weakened sections can be included on feet 228 to assist the bending, or angled surface 239 can be used. Preferably, feet 228 are securely disposed in pocket 226 by swaging or cold-forging, causing feet 228 to plastically deform to fit pocket 226. More preferably, feet 228 are inserted into pocket 226 by the process of micro-swaging, wherein approximately 15 tons of force are used to bend said feet into said pocket. This process requires significantly less force than typical swaging processes, which require about 80 tons of force to plastically deform a part. Feet 228 may have a substantially rectangular shape or may have any shape suitable for swaging. Pocket 226 may comprise a plurality of pockets having a substantially similar shape to feet 228. Main portion 240 of face insert 212 may have a substantially oval shape or any suitable shape to create a hitting surface on front 232. After insertion and swaging, feet 228 are preferably not visible from any exterior view of club head 200, as is illustrated in FIG. 14B.

To further secure face insert 212 to front 232, an adhesive or glue, such as 3M® Scotch-Weld® Epoxy Adhesive DP420, may be used to adhere upper ledge 213 of face insert 212 to lower ledge 235 of front 232. The addition of glue to the face insert-body portion subassembly not only enhances the attachment of said components, but also improves the sound and feel of the impact between club head and ball. Furthermore, the sound at impact can be controlled (hard vs. soft) by controlling the amount of glue used. It should be noted that during testing, a model club head made according to the present invention without the use of glue or adhesive was subjected to 3000 hits and produced no adverse feel or sound (rattling, looseness, etc.).

Figure 17:
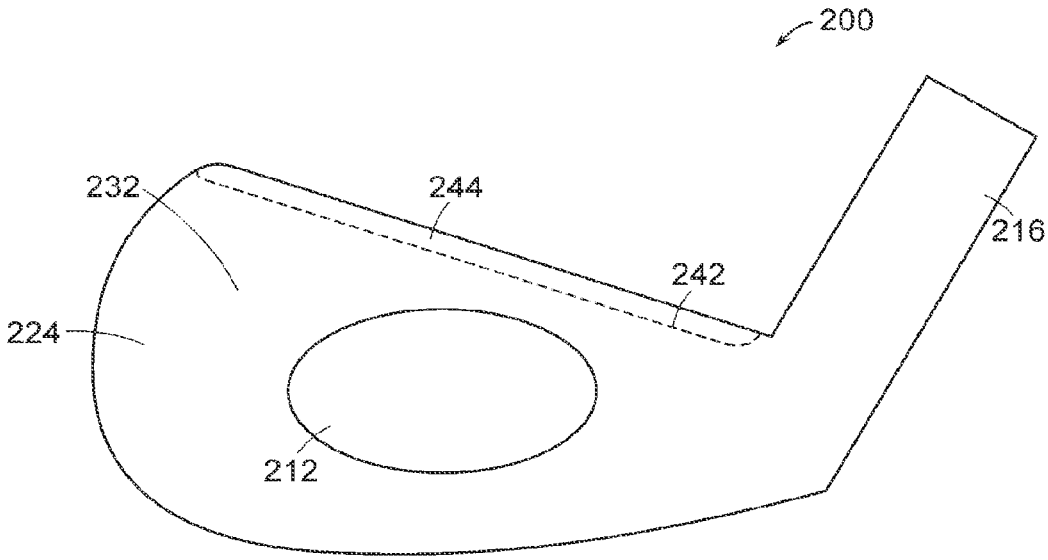
FIG. 17 is a front plan view of a golf club head of the present invention including a top line insert.

Golf club head 200 may further comprise top line insert 244, as shown in FIG. 17. Cavity 242 may be machined into or otherwise created in the top line of golf club 200 such that insert 244 may be received into cavity 242. Top line insert 244 preferably comprises a material having a density less than the density of face insert 212 and may have any shape suitable for positioning at the top line of an iron-type golf club head. For example, top line insert 244 may comprise aluminum, an aluminum alloy or a polymer. More preferably, top line insert 244 comprises a material having a density less than 2.85 g/cm$^3$. The placement of the lightweight insert at the top line of golf club head 200 causes the center of gravity of the golf club head to move downward to a more optimal position.

Figure 18:
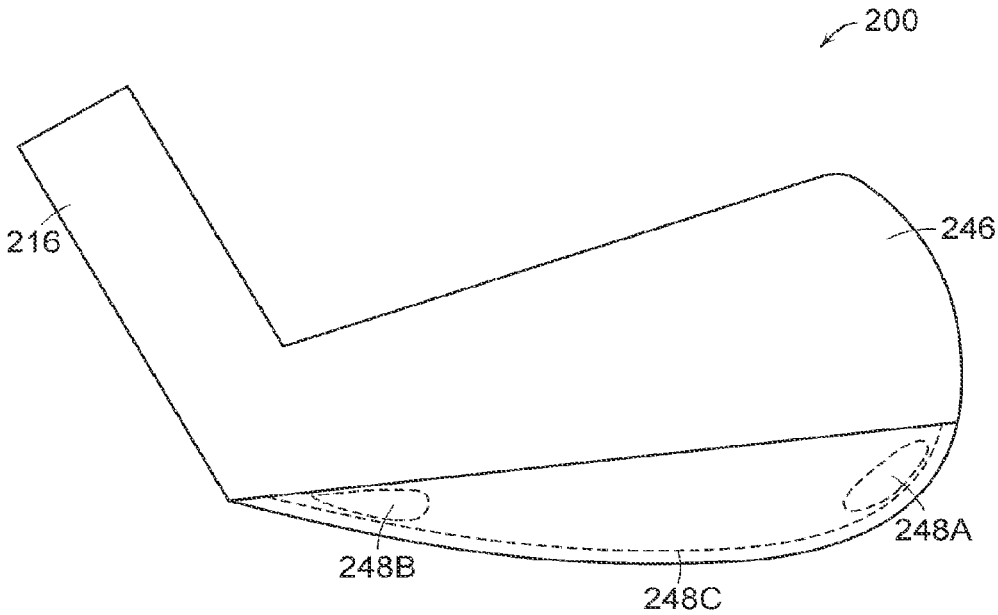
FIG. 18 is a back plan view of the golf club head of FIG. 17 including a plurality of weight members disposed on the back of the club head.

In addition to top line insert 244, golf club head 200 may also include any one of or any combination of high density weight members 248A-C, disposed to back 246, as shown in FIG. 18. Golf club head 200 is depicted as a muscle-back iron type club in FIG. 18, however, in accordance with this and all previous embodiments, golf club head 200 may also be a cavity-back iron type club head. Weight members 248A-C are preferably positioned behind and/or below the center of gravity of golf club head 200 to increase the moment of inertia of the club head. Golf club head 200 may include cavities located on back 246 toward the toe and the heel, designed to receive weight members 248A and 248B, respectively. Golf club head 200 may also include weight member or cup 248C disposed on back 246 along the perimeter of the sole of the club head. Weight members 248A-C preferably comprise a material having a density greater than the density of the material comprising body portion 224. In particular, weight members 248A-C may comprise tungsten.

As in previous embodiments of the present invention, the club head comprises multiple metals to optimize its performance. Body portion 224 comprises a first metal having a first density, while face insert 212 comprises a second metal having a second density. According to this aspect of the present invention, the first metal preferably has a greater density than the second metal to keep the center of gravity downward and aftward. Body portion 224 preferably comprises a high-strength metal or metal alloy, such as stainless steel, titanium or titanium alloy. More preferably, body portion 224 comprises stainless steel 17-4. Face insert 212 preferably comprises a metal or metal alloy exhibiting both high-strength and low density, such as aluminum, aluminum alloys or aluminum metal matrix composites (MMCs), such as those described above. More preferably, face insert 212 comprises an aluminum metal matrix composite or MMC, known as the M9 MMC.

The use of M9 in face insert 212 provides for a strong and lightweight hitting surface. M9 is a member of the 7000 series aluminum alloys, and typically includes certain amounts of magnesium, zinc and copper, with a small percentage of scandium precipitated into the metal matrix. More specifically, M9 contains approximately 0.4 percent scandium, the addition of which improves characteristics such as the tensile strength, yield strength and hardness of the alloy. The scandium can be present in the range of about 0.2% to about 0.8%, preferably from about 0.3% to about 0.6%, and more preferably about 0.4%. An amount of zirconium less than but comparable to the amount of scandium is also precipitated into the M9 metal matrix composite. Approximate attributes of M9 are shown in the table below.

| M9 | |
|---|---|
| MMC composition | Mg 3%<br>Zn 7%<br>Cu 2%<br>Sc + Zr 0.1—0.5% Al<br>balance |
| Density (g/cm$^3$) | 2.85 |
| Elongation (% in 2 in.) | 12 |
| Melting range (C.°) | 640-680 |

Compared to other aluminum alloys and MMCs, M9 has better strength and hardness. Moreover, M9 has a low density of about 2.85 g/cm$^3$, making it much lighter than stainless steel, titanium and titanium alloys, and other high-strength metals. M9 reaches its peak strength after rolling and heat-treating. The following table illustrates a number of characteristics of M9 as compared to other aluminum alloys and MMCs.

| | M9 | MMC-7 | Sc-7 | 13A | M5C |
|---|---|---|---|---|---|
| Al series | 7000 | 7000 | 7000 | 6000 | 5000 |
| Hardness (HRB) | 85-95 | 56 | 81 | 80 | 65 |
| Tensile strength (Ksi) | 94-98 | 49 | 70 | 62 | 51 |
| Yield strength (Ksi) | 85 | 45 | 62 | 54 | 37 |

In contrast to more dense metals typically used for body construction, face insert 212 comprising M9 is very light, allowing more weight to be apportioned to the back and side perimeters of body portion 224, a preferred method of weight distribution to optimize moment of inertia and center of gravity. The strength of the M9 material is similar to that of 431 stainless steel, but with much lower density. The M9 material also has better vibration absorption than forged iron. The table below shows strength and density characteristics of M9 as compared to other high-strength metals.

| | M9 | 17-4 | 431 | 8620 | Ti 6-4 |
|---|---|---|---|---|---|
| Metal | Aluminum MMC | Stainless steel | Stainless steel | Stainless steel | Titanium alloy |
| Density (g/cm$^3$) | 2.85 | 7.75 | 7.68 | 7.80 | 4.43 |
| Hardness | 85-95 HRB | 28-38 HRC | 18-25 HRC | — | 35-45 HRC |
| Tensile strength (Ksi) | 94-98 | 140 | 125 | 85 | 140 |
| Yield strength (Ksi) | 85 | 120 | 95 | 60 | 134 |
| Strength/Density (MPa/g/cm$^3$) | 237 | 125 | 112 | 75 | 218 |

As discussed above, M9 is rolled and subjected to heat-treating to increase its strength and hardness. After the hardening process, the average grain size of the M9 MMC is decreased from about ten micrometers to between three and five micrometers. To further enhance strength and durability, face insert 212 may be anodized. Preferably, face insert 212 is anodized using the Type I process discussed in previous embodiments, as the chromic acid bath of the Type I process is able to produce an oxidization layer on the surface of parts with complex geometries, such as face insert 212. Body portion 224 may also be anodized, particularly if body portion 224 is composed of titanium or titanium alloy.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s) and steps or elements from methods in accordance with the present invention can be executed or performed in any suitable order. Therefore, it will be understood that the appended claims are intended to cover all such modifications and embodiments, which would come within the spirit and scope of the present invention.

What is claimed is:

1. A golf club head comprising:

a body portion;

a face insert attached to the front of the body portion by a resin, the face insert comprising:

an aluminum metal matrix composite, an anodized surface, wherein the anodized surface of the face insert is sealed with a high-friction polymer material for increased spin, and a perimeter area, wherein the body portion further comprises a ledge configured to receive the face insert; and a hard-anodized sole plate comprising a coating impregnated with a low-friction polymer material to minimize friction when the sole plate makes contact with the ground.

2. The golf club head of claim 1, wherein the at least a portion of the anodized surface is colored.

3. The golf club head of claim 2, wherein the colored portion of the anodized surface of the face insert indicates a hitting area.

4. The golf club head of claim 1, wherein the anodized surface comprises a hard-anodic coating.

5. The golf club head of claim 1, wherein the low-friction polymer material comprises a fluorinated polymer.

6. The golf club head of claim 1, wherein the low-friction polymer material comprises polytetrafluoroethylene.

7. The golf club head of claim 1, wherein the resin only contacts a back surface of the face insert.

8. The golf club head of claim 1, wherein the resin only contacts a peripheral edge of the face insert.

9. The golf club head of claim 1, wherein the high-friction polymer material comprises an epoxy-based resin.

10. The golf club head of claim 1, wherein the high-friction polymer material comprises one selected from the list consisting of polyurethane and polyurea.

11. A golf club head comprising:

a body portion;

a face insert attached to the front of the body portion, the face insert comprising an aluminum metal matrix composite and an anodized surface, wherein the anodized surface of the face insert is sealed with a high-friction polymer material for increased spin; and a hard-anodized sole plate comprising a low-friction coating impregnated with a low-friction polymer material to minimize friction when the sole portion makes contact with the ground.

12. The golf club head of claim 11 further comprising a high density weight member positioned behind or below a center of gravity of the golf club head, wherein the high density weight member comprises a material having a density greater than a density of the body portion.

13. The golf club head of claim 11, wherein the low-friction polymer material comprises a fluorinated polymer.

14. The golf club head of claim 11, wherein the low-friction polymer material comprises polytetrafluoroethylene.

15. The golf club head of claim 11, wherein the high-friction polymer material comprises an epoxy-based resin.

16. The golf club head of claim 11, wherein the high-friction polymer material comprises polyurethane.

17. The golf club head of claim 11, wherein the high-friction polymer material comprises polyurea.

* * * * *